United States Patent [19]

Gumbinner et al.

[11] 4,052,275

[45] Oct. 4, 1977

[54] PROCESS FOR ELECTROLYTIC GRAINING OF ALUMINUM SHEET

[75] Inventors: Robert Gumbinner, Tarrytown; Jen-Chi Huang, Yonkers, both of N.Y.

[73] Assignee: Polychrome Corporation, Yonkers, N.Y.

[21] Appl. No.: 746,918

[22] Filed: Dec. 2, 1976

[51] Int. Cl.[2] ..... C25F 3/04; C25F 3/00

[52] U.S. Cl. ..... 204/129.95; 204/129.75

[58] Field of Search ..... 204/129.95, 129.75, 204/129.85

[56] References Cited

U.S. PATENT DOCUMENTS

| | | | |
|---|---|---|---|
| 3,728,237 | 4/1973 | Heijenbrok et al. | 204/129.95 |
| 3,935,080 | 1/1976 | Gumbinner et al. | 204/129.75 |
| 3,963,594 | 6/1976 | Brasko | 204/129.95 |
| 3,980,539 | 9/1976 | Lloyd et al. | 204/129.75 |

*Primary Examiner*—T. M. Tufariello

[57] ABSTRACT

A method for electrolytically graining the surface of aluminum sheets useful in the production in lithographic printing plates which comprises subjecting said aluminum sheets to the action of an electric current in an aqueous electrolytic solution containing, in combination, small but effective amounts of both hydrochloric and tartaric acids.

5 Claims, No Drawings

PROCESS FOR ELECTROLYTIC GRAINING OF ALUMINUM SHEET

This invention relates to a method of graining the surface of aluminum sheets which are useful in the production of lithographic printing plates. More particularly, this invention relates to a method of imparting a very fine grain to the surface of aluminum sheets designed for use in the production of lithographic printing plates, which method comprises treating an aluminum sheet with an electrical current in an aqueous electrolytic solution containing as electrolytes a combination of small but effective amounts of hydrochloric acid and tartaric acid.

In the manufacture of lithographic printing plates, it has been found most desirable to employ aluminum or aluminum alloy sheets as the base support therefore. In addition, it has been found that most satisfactory aluminum lithographic plates are obtained when the surface of the aluminum or aluminum alloy base support sheet is treated to impart thereto a grained or roughened character. Heretofore, a number of methods have been employed to impart a grained surface to the aluminum base support sheet, including both mechanical and electrochemical processes.

The mechanical graining method of treating aluminum sheets, for example, by wire brushing, results in a grained surface which is relatively rough and uneven, and in many lithographic printing applications does not give satisfactory results. It is also known that the electrolytic graining of aluminum can provide a fine and uniform grain to the surface of the aluminum. Various methods of electrolytically graining aluminum sheets have been employed, for example, as taught by U.S. Pat. Nos. 3,072,546, 3,073,765 and 3,980,539, and French Pat. 2,110,257. In some of the prior art processes employed it has been found that unless the process is carefully controlled, the resultant grained surface obtained can be pitted, coarse and irregular, characteristics which are not desirable in lithographic printing plates.

We have now found a method for promptly and efficiently electrolytically graining the surface of aluminum sheets in such a manner as to yield aluminum sheets which have a very fine and uniform grain surface which is most desirable for use in the production of lithographic printing plates. More particularly, the process of this invention comprises electrolytically graining aluminum in an aqueous electrolyte solution containing hydrochloric acid and tartaric acid with an electric current yielding a current density in excess of 40 amperes per square foot and with concentrations of hydrochloric acid and tartaric acid sufficient that a fine, uniform grain that is substantially free from pits is formed on the surface of the aluminum thus treated.

In the successful practice of the process of this invention, the aluminum which is contemplated to be employed is that aluminum or aluminum alloys which are designed and intended for employment in the production of lithographic printing plates. Thus, the aluninum to be employed herein are such aluminum sheets and webs which are specifically designed for use in the manufacture of lithographic printing plates, and includes such aluminum as is produced and sold by the Aluminum Company of America as lithographic grade Alloy No. 3003, or Alloy No. 1100, as generally known and understood in the industry.

The aluminum may then be electrolytically treated in accordance with the process of this invention. The electrolytic solution employed in the practice of this invention is an aqueous electrolytic solution which requires the presence, in combination, of a small but effective amount of hydrochloric acid and a small but effective amount of tartaric acid, as the active electrolytes. More specifically, it has been found that most successful results are obtained when the aqueous electrolytic solution contains concentrated hydrochloric acid in combination with tartaric acid. It has also been found that satisfactory results are obtained when the concentrated hydrochloric acid (defined as containing at least 32% HCl by weight) is present in the electrolytic solution in a concentration of from at least 0.75% to about 3.5% by weight, and most preferably, in a concentration of from 1.5% to 2.5% by weight. The tartaric acid electrolyte should also be present in the aqueous electrolytic solution in a concentration of at least 0.2% to about 1.0% by weight and preferably, in a concentration of from 0.3% to 0.75% by weight.

The electrolytic current which is employable in the practice of this invention is that which will provide a current density in excess of 40 amperes per square foot. Most satisfactory results can be obtained when the current applied in the electrolytic graining process of this invention provides a current density of from 200 to 500 amperes per square foot of aluminum surface being treated, and most preferably, a current density of from 250 to 350 amperes per square foot.

It has also been found in the practice of this invention that the temperature at which the process is operated is critical in achieving the desired results. The temperature at which the electrolytic graining process is conducted must be maintained at a high enough level to assure that a fine, uniform grain is obtained. It has been determined that satisfactory results are obtained when the temperature of operation is maintained above 45° C. and preferably between 45° C. and 75° C. If the temperature at which the electrolytic graining is conducted is too low, for example, below 40°–45° C. the grain obtained is undesirably rough and not usually employable in the production of lithographic printing plates.

The electrolytic graining process of this invention may be carried out in a batch, semi-continuous or continuous manner, employing the aluminum to be treated hereunder in the form of either sheets, foils or in continuous webs, as may be desired by the skilled worker. While the amount of time required for the completion of the process of this invention may vary, according to the conditions of operation under which it is practiced by the skilled worker, it has been found that satisfactory results can be obtained in a time period as little as thirty seconds. Most satisfactory results have been obtained when the process is practiced for from 60 to 90 seconds, although other periods of operation also provide satisfactory results.

The invention may be further illustrated by the following Examples.

EXAMPLE 1

A piece of aluminum foil 0.4 mm thick and measuring 4 inches square was immersed in a 5% w/w solution of NaOH for 30 seconds at room temperature to clean the surface thereof. The aluminum alloy was purchased as lithographic grade aluminum Alloy No. 3003 from the Aluminum Company of America. The thus treated aluminum was then washed and immersed in an electrolytic bath containing 1.75% by weight of concentrated hydrochloric acid and 0.5% by weight of tartaric acid in deionized water. An alternating current at 15 volts and a current density of 300 amperes per square foot was passed from the foil through the electrolyte to a counter electrode for a period of one minute. The temperature of the electrolytic bath was maintained at about 55° C. during the process. Only one side of the aluminum foil sample was grained, the back thereof being effectively masked. The foil was then washed with water.

EXAMPLE 2

The procedure of Example 1 was followed except that the tartaric acid electrolyte was omitted from the electrolytic solution. The resultant grained foil was obtained and the surface roughness of the two foil samples were compared by Perth-O-Meter (Trademark of Perthen Co.). Higher reading indicating rougher surface.

| Grained Surface Foil | Roughness Value |
|---|---|
| Example 1 | 6 |
| Example 2 | 7.5 |

The foregoing results demonstrate that the process of the instant invention provides a smoother grain.

The invention may be variously otherwise embodied within the scope of the appended claims.

1. A method for electrolytically graining aluminum which comprises immersing the aluminum in an aqueous electrolytic solution containing hydrochloric acid and tartaric acid as electrolytes, applying thereto an electric current having a current density in excess of 40 amperes per square foot and maintaining the electrolytic solution at a temperature of about 45° C wherein the tartaric acid is present in a concentration of from 0.2% to 1.0% by weight and wherein the hydrochloric acid is present in a concentration of from 0.75% to 3.5% by weight.

2. The method of claim 1 wherein the electric current is applied at a current density of 50 to 500 amperes per square foot.

3. The method of claim 1 wherein the hydrochloric acid is present in a concentration of from 1.5% to 2.5% by weight; the tartaric acid is present in a concentration of from 0.3% to 0.75% by weight; and the current is applied at a current density of from 200 to 500 amperes per square foot.

4. The method of claim 1, wherein the temperature of the electrolytic solution is maintained at a temperature of from 45° C. to 75° C.

5. The grained aluminum product manufactured according to the method of claim 1.

* * * * *